US005860522A

United States Patent [19]

Lee

[11] Patent Number: 5,860,522

[45] Date of Patent: Jan. 19, 1999

[54] HOLDER FOR TOOTHBRUSH AND TOOTHPASTE

[76] Inventor: Jae Ho Lee, 521 Broad Ave., Palisades Park, N.J. 07650

[21] Appl. No.: 955,395

[22] Filed: Oct. 21, 1997

[51] Int. Cl.[6] ..... B65D 83/10

[52] U.S. Cl. ..... 206/362.2; 206/361; 401/125; 401/284

[58] Field of Search ..... 206/362.2, 361, 206/216; 132/308; 401/125, 284

[56] References Cited

U.S. PATENT DOCUMENTS

| | | | |
|---|---|---|---|
| 1,062,480 | 5/1913 | LaRocque . | |
| 2,652,064 | 9/1953 | Shook | 401/284 |
| 2,856,971 | 10/1958 | Francolino | 401/284 |
| 4,503,871 | 3/1985 | Mendenhall . | |
| 4,521,128 | 6/1985 | O'Neal . | |
| 4,835,813 | 6/1989 | Lorenzana et al. . | |
| 4,850,074 | 7/1989 | Klevan | 15/185 |
| 4,866,809 | 9/1989 | Pelletier | 206/216 |
| 5,044,039 | 9/1991 | Picard . | |
| 5,049,039 | 9/1991 | Andrews . | |
| 5,052,566 | 10/1991 | Wilkinson . | |
| 5,078,526 | 1/1992 | Corona | 401/125 |
| 5,213,428 | 5/1993 | Salman . | |
| 5,400,457 | 3/1995 | Ridgley . | |
| 5,476,334 | 12/1995 | Tello-Vallarino | 401/268 |

*Primary Examiner*—David T. Fidel
*Attorney, Agent, or Firm*—Arthur Jacob

[57] ABSTRACT

A portable toothbrush case, suitable for use away from home, contains separate compartments for storage of a toothbrush and toothpaste. The compartments are separated by a central partition with a hole that allows toothpaste to flow from its storage space onto the bristles of the toothbrush. Pressing on a portion of the wall of the toothpaste storage compartment squeezes the toothpaste through the hole, onto the toothbrush. Another hole on the outside wall of the toothpaste storage compartment allows refilling from a conventionally designed tube of toothpaste.

7 Claims, 4 Drawing Sheets

HOLDER FOR TOOTHBRUSH AND TOOTHPASTE

BACKGROUND OF THE INVENTION

It has been known for many years that dentists recommend the practice of brushing teeth regularly to avoid tooth decay and keep teeth and gums healthy. Often however, a person cannot be home to conveniently brush his or her teeth. Brushing while away from home requires the inconvenience of carrying a toothbrush and toothpaste separately and applying the toothpaste to the toothbrush.

The present invention permits the user to carry both toothbrush and toothpaste together, in a manner that allows easy and convenient use, at any time and at any location. While there have been toothbrushes in the prior art that allowed for storage of toothpaste, these brushes required special handle designs to accommodate storage of toothpaste. Moreover, the special handle designs necessitated by these toothbrushes deprived the user of the comfort of using the toothbrush that he or she has become accustomed to using. It is therefore an objective of this invention to store a toothbrush and toothpaste in one device with the feature that the invention can be used with any style of toothbrush. It is a further objective of this invention to allow the device disclosed to be refilled with toothpaste when it becomes empty and to be washed between fillings and toothpaste.

There have been recent advances in the art of toothbrush covers for use when travelling or otherwise away from home: Lorenzana U.S. Pat. No. 4,835,813 (1989), Picard, U.S. Pat. No. 5,044,039 (1991), Andrews, U.S. Pat. No. 5,048,144 (1991) Wilkinson, U.S. Pat. No. 5,052,556 (1991). The inventions were merely protective caps for the toothbrush, providing protection for the bristles but not combining the storage of toothpaste. Salman, U.S. Pat. No. 5,213,428 (1993) teaches a diminutive "toothbrush" that fits over the distal portion of the finger, with the finger providing the required structural rigidity. Again however, toothpaste must be carried separately, further matters of taster were not considered.

The prior art in combining toothbrush and toothpaste in one portable unit has proved cumbersome. Larocque, U.S. Pat. No. 1,062,480 (1913) teaches a tube of toothpaste on an extender arm pivotally mounted to the body of the toothbrush. More recently, Mendenhall U.S. Pat. No. 4,503,871 (1985) placed compartments for packages of toothpaste in the handle of a toothbrush, and O'Neal U.S. Pat. No. 4,521,128 (1985) placed a large diameter handle of a disposable toothbrush. In the last two cases, the toothbrushes utilized of necessity, a handle much larger and thicker than is needed on a standard toothbrush. These inventions are all incompatible with the use of a conventional toothbrush while the user is traveling or otherwise away from home.

BRIEF DESCRIPTION OF THE INVENTION this invention is a Portable Toothbrush Case that stores both toothbrush and toothpaste in separate compartments until the time for use. Both compartments are elongated and are placed side by side, separated by a central wall. In the practice of the invention, the toothbrush is stored in its compartment with its bristles facing the compartment containing the toothpaste. The toothpaste container can be compressed by pressing on a surface that forms part of the end wall of the toothpaste compartment. When the user presses this surface, toothpaste is squeezed out of its compartment, through a hole in the wall separating the two compartments and onto the bristles of the toothbrush. There is also a hole in the outside wall of the toothpaste compartment. This part of the wall surrounding this hold has an inside thread that compliments the outside thread on the nozzle of a tube of toothpaste. In this manner, the device can be refilled with toothpaste for future use.

DETAILED DESCRIPTION OF THE INVENTION

The device described here is a container for a toothbrush and toothpaste, made of a flexible plastic such as that used for toothbrush covers in the conventional art. For example, the invention can be made of injection molded polethylene, although the choice of material is not critical.

Figure 1:
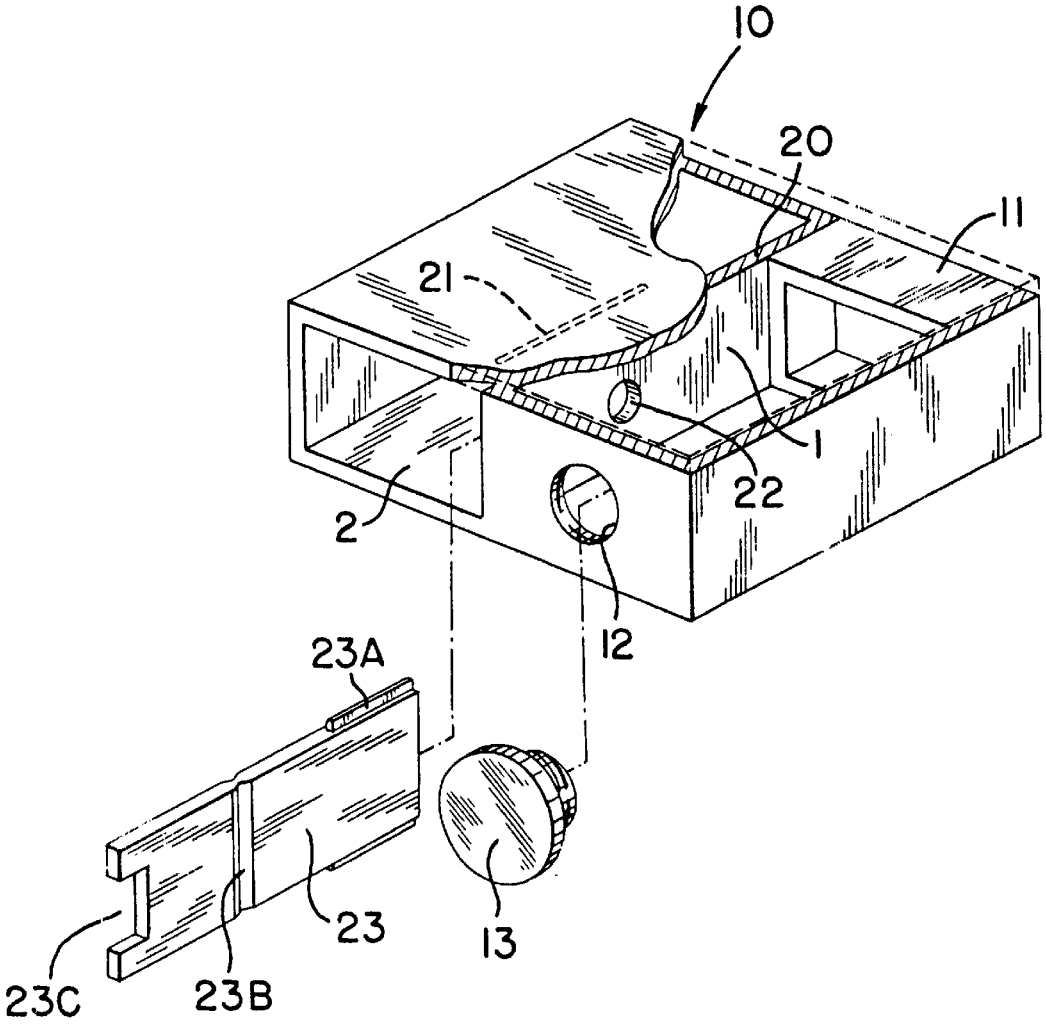
FIG. 1 is an elevational view of the invention with two of its components shown in an exploded view.

FIG. 1 shows the general layout of the device which forms the subject matter of this invention. The Main Body of the device 10 contains a Toothpaste Storage Space 1 and a Toothpaste Compartment 2. Main Body 10 is solid in the actual device, but is cut away in this view to reveal other features of the invention. Partition 20 separates Toothpaste Storage Space 1 from Toothbrush Compartment 2. End piece 11 forms one part of the outside wall of Toothpaste Storage Space 1 and is slidably mounted along the inside walls, floor and ceiling of Toothpaste Storage Space 1. A Press Surface on the outside surface of End Piece 11 allows compression of toothpaste in Toothpaste Storage Space 1 when it is desired that toothpaste to be applied to the toothbrush preparatory to the brushing operation. Toothpaste Hole 12 is used for filling toothpaste Storage Space 1 when refilling Toothpaste Storage Space 1 with additional toothpaste as required. Partition 20 separates the two compartments as aforementioned except for Toothpaste Supply Hole 22, which allows toothpaste to be applied in the toothbrush in Toothbrush Compartment 2. Between Partition 20 and Toothbrush Compartment 2 is Slider Guide 21, indented into the ceiling of Toothbrush Compartment 2. An identical Slider Guide not shown, is indented into the floor of Toothbrush Compartment 2, parallel to Slider Guide 21. These Slider Guides accommodate Slider 23. Slider Mount 23A and its identical counterpart protruding from the bottom of Slider 23 fits into Slider Guide 21 and its counterpart at the floor of Toothpaste Compartment 2. Connector 23B is a thin section of Slider 23, running vertically along Slider 23 and allowing the two planar components of Slider 23 thus formed to pivot with respect to each other. Slider Support 23C can thus be pivoted to cover the opening to Toothbrush Compartment 2. A notch in Slider Support 23 allows the protrusion of the handle of a toothbrush from the confines of the device. Screw Lid 13 is a thumb screw containing an outside threaded surface that screws into the reciprocal inside threads around the circumference of Toothpaste Hole 12.

In the normal operation of the invention, Screw Lid 13 will remain screwed into Toothpaste Hole 12, so that Toothpaste Hole 12 will be covered and closed. The outside thread of Screw Slide 13 is the same as the outside thread of a conventional tube of toothpaste, and the inside thread around the circumference of Toothpaste Hole 12 accommodates the outside thread on the nozzle of a conventional tube of toothpaste. During the filling operation, Screw Lid 13 is unscrewed to open Toothpaste Hole 12. A tube of toothpaste (not depicted) is screwed into Toothpaste Hole 12. The tube of toothpaste is then squeezed to force toothpaste into Toothpaste Storage Space 1. When sufficient toothpaste has been squeezed into Storage Space 1, Screw Slide 13 is replaced and Toothpaste Hole 12 is closed. It should be noted that Toothpaste Supply Hole 22 is closed by moving Slides 23 into a position covering Toothpaste Supply Hole 22 during the filling operation.

Figure 2A:
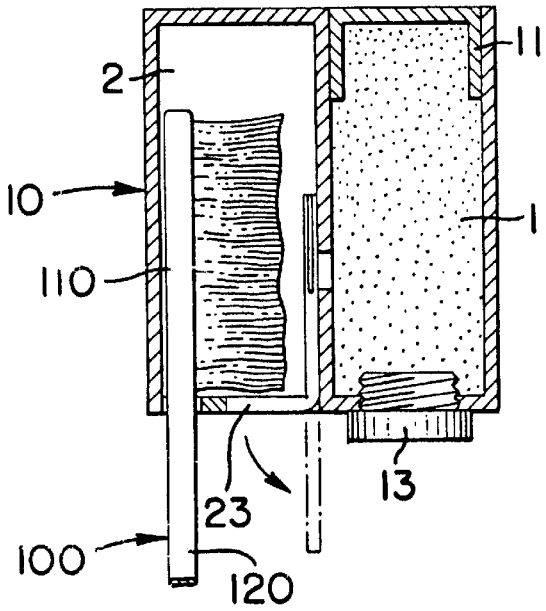
FIGS. 2A, 2B and 2C are top views illustrating the use of the device.
Figure 2B:
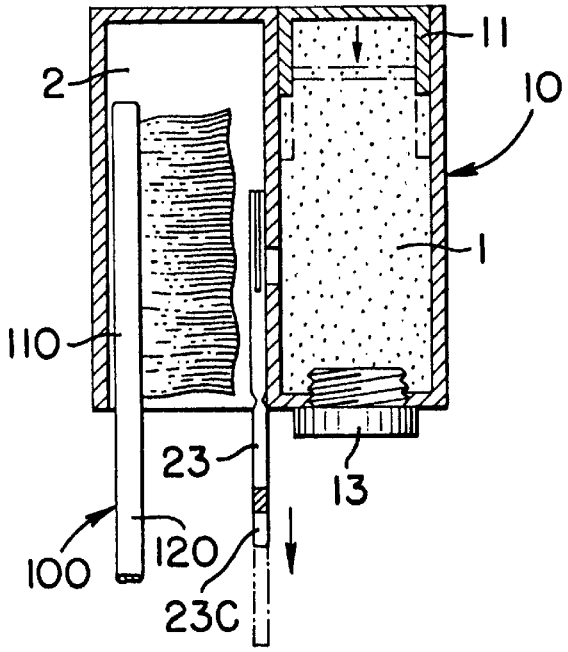
Figure 2C:
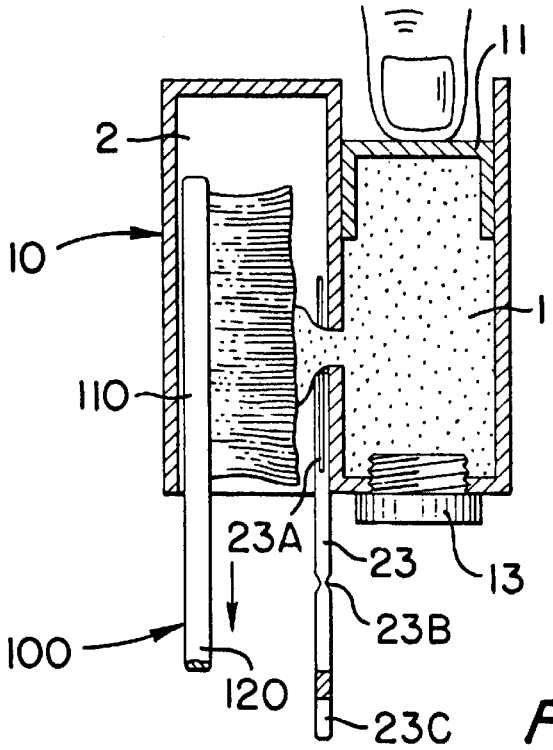

FIGS. 2A through 2C show the device in various positions during the operation of applying toothpaste to the toothbrush contained within the device, preparatory to the brushing of teeth.

In FIG. 2A Toothpaste Storage Space 2 is full, as indicated by the position of End piece 11 against the outside wall of Toothpaste Storage Space 2. Members that prevent End Piece 11 from being pushed beyond the outer wall of Main Body 10 are not depicted and this can be accomplished by an stopping means known in the conventional art. Screw Lid 13 is in "closed" position, and Slider 23 has closed Toothpaste Supply Hole 22, so that toothpaste is not being applied to Toothbrush 100. IT should be noted that Toothbrush 100 is in Toothbrush Compartment 2, with its bristles facing Toothpaste Storage Space 1, awaiting the application of toothpaste.

In FIG. 2B Slider 23 has moved slightly so that Slider Support 23 is now protruding from the device. The arrow at the end of Toothpaste Storage Space 1 where End Piece 11 is located shows the direction of movement of End Piece 11 that will occur during the operation of applying toothpaste to Toothbrush 100.

FIG. 2C shows the device as position during the operation of applying toothpaste to Toothbrush 100. Slider 23 has been moved further than was depicted in FIG. 2B thereby allowing the flow of toothpaste through Toothpaste Supply Hole 22. The user's finger has applied pressure to the Press Surface of End Piece II thereby moving it in the direction of motion permitted and forcing toothpaste through Toothpaste Supply Hole 22 onto Toothbrush 100. Toothbrush 100 is now ready for use.

Figure 3:
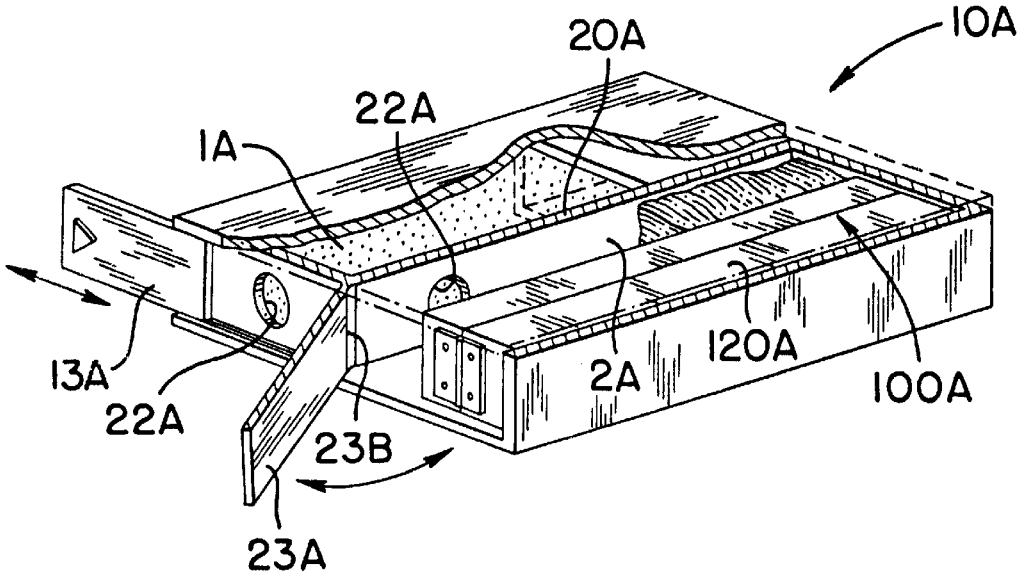
FIG. 3 is a view of the device with a collapsable toothbrush stored inside its compartment.

FIG. 3 shows the device described with a collapsable toothbrush contained therein. The art of Toothbrush 100 A contains Arm 120A which is hinged to the arm half containing the bristles of the toothbrush, depicted in previous drawing figures as 110. Slider Mount 23A functions as a door, pivoting into a position to close as part of the wall of Main Body 10A, thereby keeping Toothbrush 100A insider Toothbrush Storage Compartment 2A. In this alternate embodiment of the invention, Sliding Door 13A closes over Toothpaste Hole 12A when the device is not being filled with toothpaste. Toothpaste Storage Space 1A is otherwise identical to its counterpart in earlier drawing figures.

Figure 4:
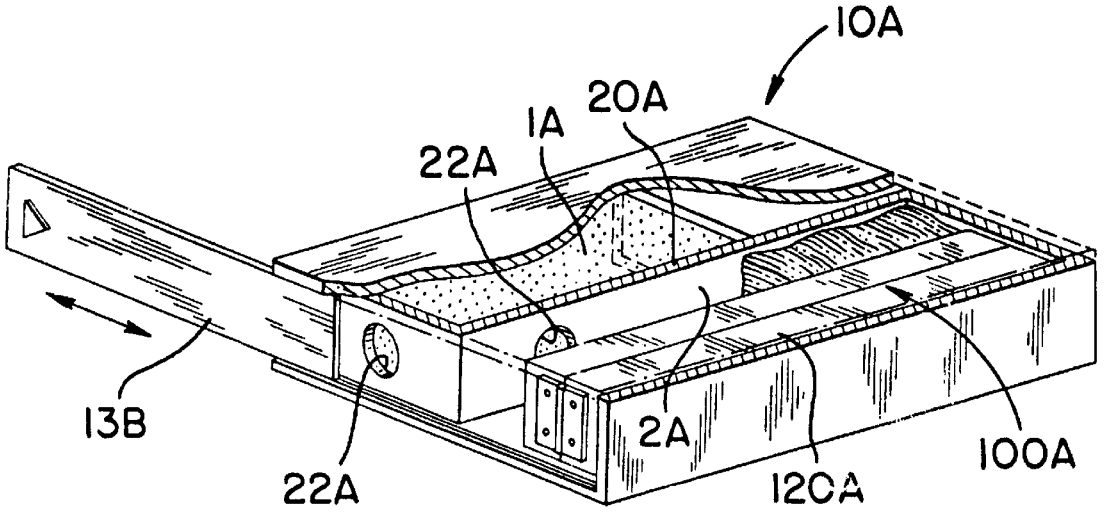
FIG. 4 is a view of the device with the Toothpaste Supply Hole open for refilling with more toothpaste.

FIG. 4 shows a slightly different embodiment than is depicted in FIG. 3. Sliding Door 13B runs the length of the front wall to Main Body 10A. In the fully open position, Sliding Door 13 accommodates the refilling operation by exposing Toothpaste Hole 22A. In the partially closed position, Sliding Door 13B allows the removal of Toothbrush 100A. When Sliding Door 13B is in the fully close deposition, Toothbrush 100A remains inside the confines of Toothbrush Compartment 2A.

Figure 5:
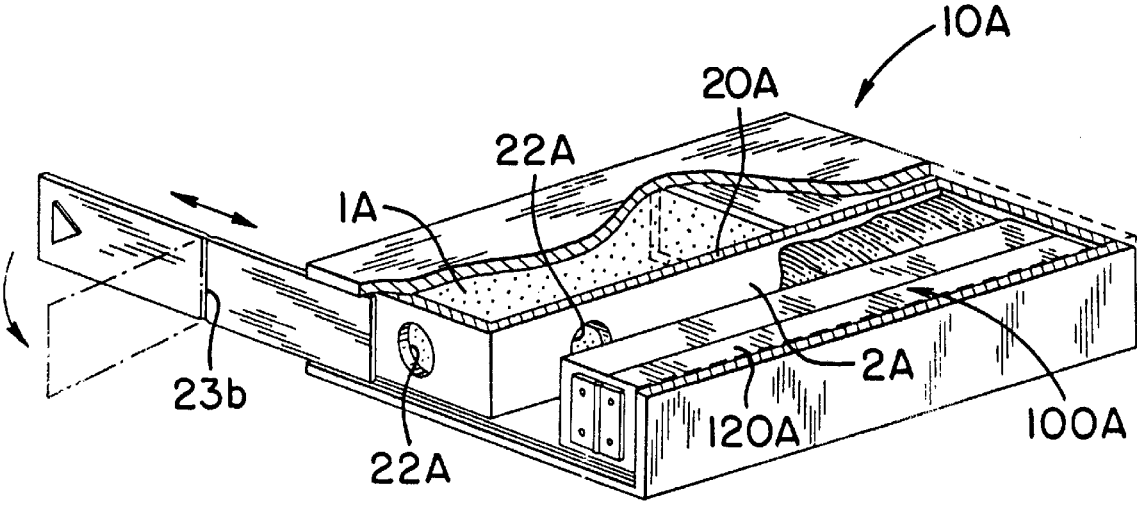
FIG. 5 shows an alternative embodiment of the invention, wherein the sliding door that covers the Toothpaste Supply Hole is comprised of two planar components which are pivotally mounted with respect to each other.
Figure 6:
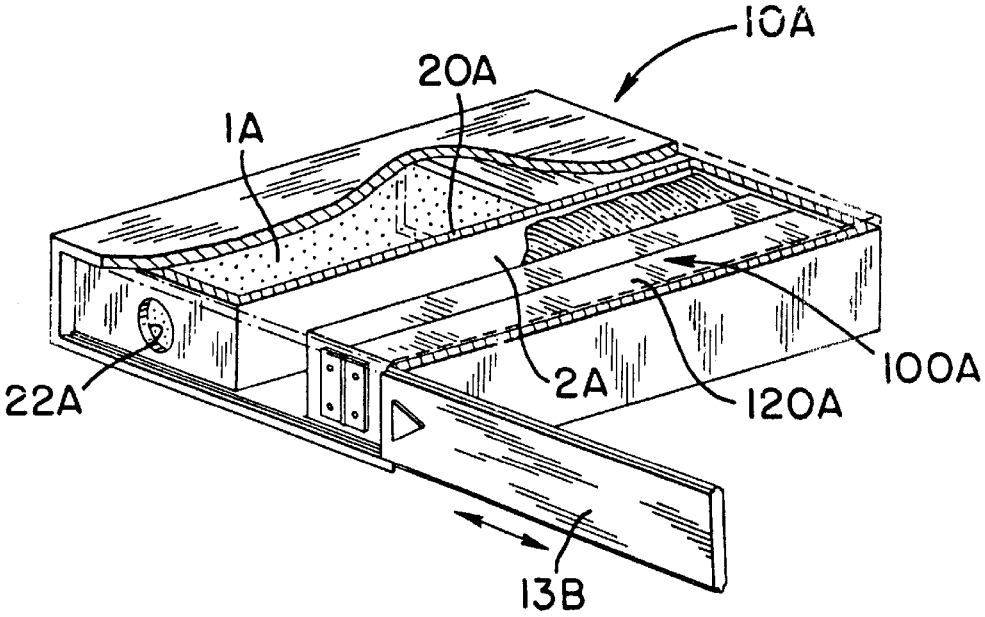
FIG. 6 shows a toothbrush in place inside the device, ready for the dispensing of toothpaste onto it.

FIGS. 5 and 6 show different embodiments of Sliding Door 13B. In FIG. 5, Sliding Door 13B contains Ridge 23B running vertically thereby dividing Sliding Door 13B into two planar components that pivot with respect to each other, thereby allowing Sliding Door 13B to protrude a shorter distance during the toothpaste refilling operation than occurs during the same operation under the embodiment depicted in FIG. 4. In FIG. 6 Sliding Door 13B is a solid member opening first to expose Toothpaste Supply Hole 22A and later Toothbrush Storage Compartment 2A.

The operations of applying toothpaste to toothbrush and refilling the device with toothpaste from a conventional toothpaste tube are the same, regardless of the embodiment of the invention. The invention can accommodate the storage of a collapsable toothbrush inside it storage compartment, or a conventional toothbrush with a rigid arm can also be accommodated. The embodiments of the invention as shown and described are meant to be illustrative and not limiting. Other applications and embodiments of the invention are possible, and should be considered as lying within its scope.

The invention claimed is:

1. A portable storage case for storing toothpaste and a toothbrush with the capability of being refilled with toothpaste, comprising:

a compartment for storing a toothbrush;

a compartment for storing toothpaste;

the compartment for storing a toothbrush being adjacent the compartment for storing toothpaste;

a partition dividing the compartment for storing a toothbrush from the compartment for storing toothpaste, the partition containing a hole through which toothpaste can be squeezed for application onto bristles of a toothbrush;

a means for closing said hole when toothpaste is not being applied onto the bristles of the toothbrush, the means for closing said hole being a member slidably mounted adjacent to and parallel to the partition that separates the compartment for storing a toothbrush from the compartment for storing toothpaste, said slidably mounted member further comprising a means for dividing said member into two planar components, themselves pivotally mounted with respect to each other;

a means for applying toothpaste stored in the compartment for storing toothpaste onto bristles of a toothbrush stored in the compartment for storing a toothbrush; and a means for refilling the compartment for storing toothpaste with additional toothpaste when toothpaste previously placed in the compartment for storing toothpaste has been consumed.

2. A portable storage case for storing toothpaste and a toothbrush with the capability of being refilled with toothpaste, comprising:

a compartment for storing a toothbrush;

a compartment for storing toothpaste, a means for applying toothpaste stored in the compartment for storing toothpaste onto bristles of a toothbrush stored in the compartment for storing a toothbrush; and a means for refilling the compartment for storing toothpaste with additional toothpaste when toothpaste previously placed into the compartment for storing toothpaste has been consumed, the means for refilling the compartment for storing toothpaste comprising a hole in an outer wall of the compartment for storing toothpaste, through which hole toothpaste enters the compartment for storing toothpaste during a refilling process; and a slidably mounted member extending parallel to the outer wall within which said hole is located, said slidably mounted member being capable of being positioned to expose said hole during the refilling operation and to cover said hole at other times.

3. The case as in claim 1, further comprising a means for compressing the compartment for storing toothpaste to force the toothpaste contained therein through said hole and onto the bristles of said toothbrush.

4. The case as in claim 2, in which the means for compressing said compartment for storing toothpaste is a member comprising one outside wall of said compartment for storing toothpaste with the smallest area of any of the outside walls of said compartment for storing toothpaste, slidably mounted within said compartment for storing toothpaste and capable of moving only in a direction along a line parallel to the orientation of a plane formed by tips of the bristles of said toothbrush.

5. The case as in claim 2 in which said hole is threaded with a thread complementary and reciprocal to an outside thread on a nozzle of a tube of toothpaste and exposed when a cap normally screwed onto said nozzle is removed for selective coupling of the tube of toothpaste to the compartment for storing toothpaste.

6. The case as in claim 5, further comprising a thumb screw having a thread complementary and reciprocal to the thread of said hole, the thumb screw being removably mounted within said hole for selective removal during the refilling operation.

7. The case as in claim 1, further comprising a collapsible toothbrush stored in the compartment for storing a toothbrush, with the collapsible toothbrush being in position to accommodate the application of toothpaste to its bristles.

* * * * *